United States Patent [19]

Heurteux

[11] 4,014,627

[45] Mar. 29, 1977

[54] COMPRESSOR STATOR HAVING A HOUSING IN ONE PIECE

[75] Inventor: Bernard Heurteux, Verviers, Belgium

[73] Assignee: Shur-Lok International S.A., Petit-Rechain, Belgium

[22] Filed: July 22, 1975

[21] Appl. No.: 598,027

[30] Foreign Application Priority Data

Aug. 21, 1974 France ..... 74.28742

[52] U.S. Cl. ..... 415/189; 415/201; 415/217

[51] Int. Cl.[2] ..... F01D 1/02

[58] Field of Search ..... 415/216, 217, 218, 189, 415/201; 416/215, 216; 81/66 R; 24/285, 286

[56] References Cited

UNITED STATES PATENTS

| | | | |
|---|---|---|---|
| 1,173,496 | 2/1916 | Elzay | 81/66 R |
| 2,352,372 | 6/1944 | Colarusso | 24/286 |
| 2,489,535 | 11/1949 | Montague | 24/285 |
| 2,661,147 | 12/1953 | Anderson | 415/218 |
| 2,945,290 | 6/1960 | Walsh | 415/218 |
| 3,105,281 | 10/1963 | Doherty | 24/285 |
| 3,326,523 | 6/1967 | Bobo | 415/218 |
| 3,807,895 | 4/1974 | McMurtry | 416/215 |

FOREIGN PATENTS OR APPLICATIONS

| | | | |
|---|---|---|---|
| 599,391 | 3/1948 | United Kingdom | 415/217 |

*Primary Examiner*—Henry F. Raduazo
*Attorney, Agent, or Firm*—Holman & Stern

[57] ABSTRACT

In this compressor stator having a housing in one piece a circumferential groove having a radially inner part of reduced width is formed for each stage in the wall of the cavity of the housing and communicates with the exterior of the housing by way of at least one radial opening having sufficient size to provide a passage for a vane base. The vane bases are disposed in a contiguous fashion in the groove and are radially supported by said inner part of the latter. A chain surrounds all the bases and bears radially against each one thereof.

11 Claims, 6 Drawing Figures

COMPRESSOR STATOR HAVING A HOUSING IN ONE PIECE

The present invention relates to a compressor stator intended in particular for nuclear compressors, and it more particularly concerns compressor stators of the type comprising a housing in a single piece having an inner cavity of revolution and at least one stage of vanes which are each provided with a base fixed in the wall of the cavity.

The compressor stators of this type have the advantage of having no joint plane owing to the fact that the housing is constructed in a single piece so that there is no risk of ovalization upon temperature rise.

An object of the invention is to provide a stator of the aforementioned type which permits a positioning and a rapid and strong fixing of the vanes in the housing.

For this purpose, the invention provides a compressor stator of the aforementioned type, wherein a circumferential groove having a radially inner part of reduced width is provided, for each stage, in the wall of the cavity of the housing and communicates with the exterior of the housing by way of at least one radial opening of sufficient size to provide a passage for a vane base, the vane bases are disposed in a contiguous manner in the groove and bear radially against said inner part of the groove and a chain surrounds all the bases by bearing radially against each one thereof.

Further features and advantages of the invention will be apparent from the ensuing description given merely by way of a non-limitative example with reference to the accompanying drawings in which.

Figure 1:
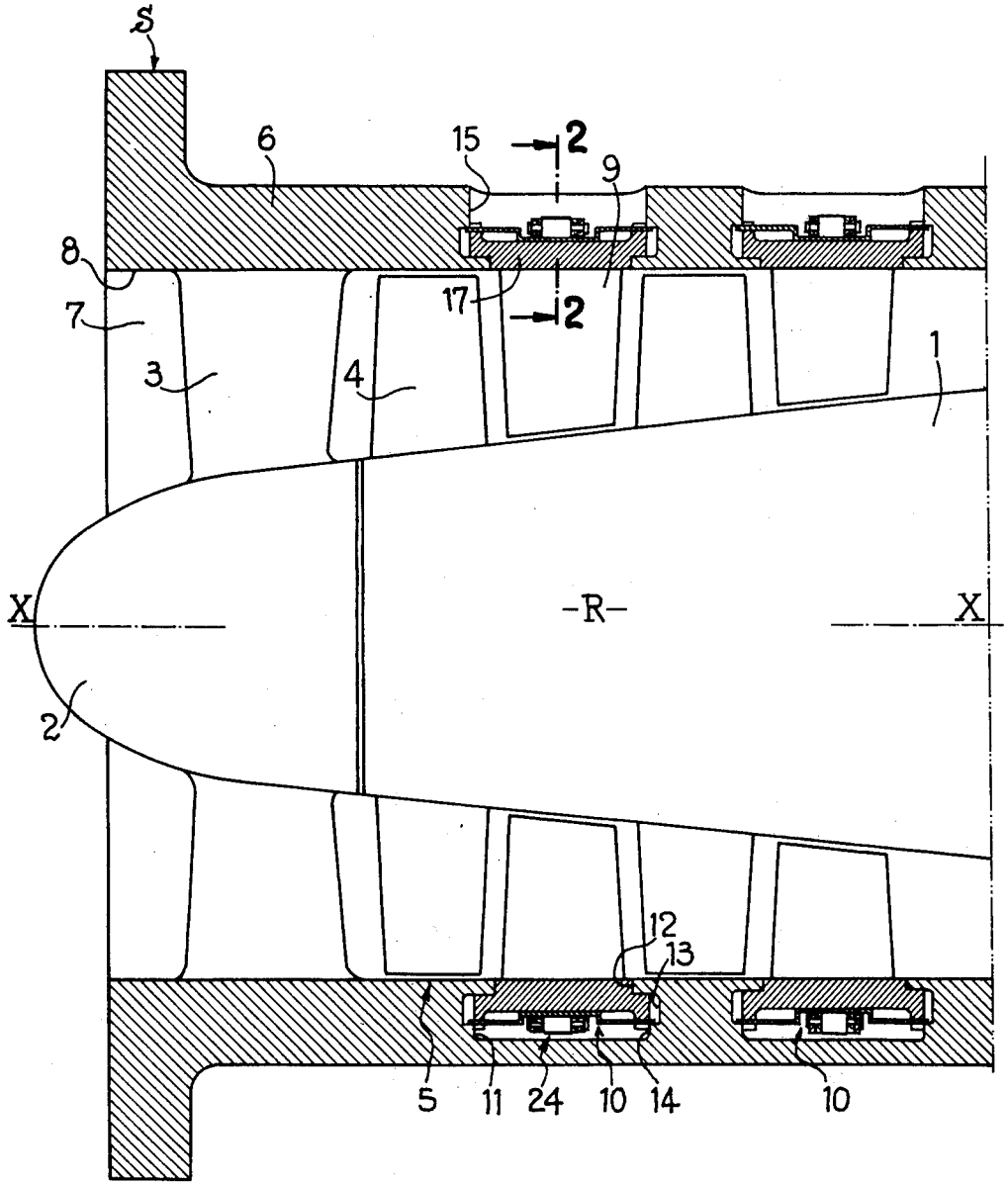
FIG. 1 is a partial axial sectional view of a compressor provided with a stator according to the invention.

The compressor shown in FIG. 1 comprises a stator S having an axis X—X and a rotor R of the same axis and rotating inside the stator. The rotor shaft 1 is substantially frustoconical and rotatably mounted in a faired end bearing 2 which is connected to one of the ends of the stator S by radial arms 3 which are also faired. The rotor shaft 1 carries a number of profiled vanes 4 forming a plurality of groups each of which is located in a plane perpendicular to the axis X—X. Each group constitutes a stage of moving vanes 5.

The stator S comprises a housing 6 which has an inner cavity 7 in which the rotor R is disposed, the wall 8 of the cavity being cylindrical and having a circular section. Fixed profiled vanes 9 extending inwardly of the cavity 7 to within the vicinity of the rotor R are fixed in the wall 8 of the housing 6. These fixed vanes 9 are also grouped into rows or stages 10 located on the whole in planes perpendicular to the axis X—X. The stages 10 of fixed vanes and the stages 5 of moving vanes alternate along the axis X—X. The stages 10 and the stages 5 form therebetween a stage of the compressor.

In the region of each fixed vane stage 10, the housing 6 is provided with a circumferential groove 11 formed in the wall 8 of the cavity 7. This groove 11 has, when viewed in cross section (FIGS. 1, 5 and 6), three successive parts of unequal width: a narrow part 12 which is radially the innermost part and opens onto the interior of the cavity 7; a median part 13 of greater width; and a part 14 of a width intermediate the two foregoing widths and located radially outermost. As can be seen in FIG. 1, the groove 11 communicates with the exterior of the housing 6 by way of one or more radial openings 15 which have in plan the shape of a parallelogram and whose axial dimension, that is to say the dimension in the direction parallel to the axis X—X, is that of the outer part 14 of the groove 11. In order to facilitate the description, it will be assumed that a single opening 15 is provided per stage.

Figure 4:
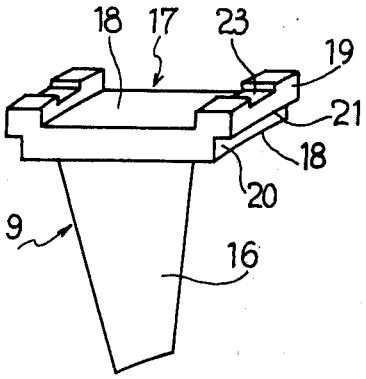
FIG. 4 is a perspective view of a vane of this stator.

A stator vane 9 (FIG. 4) comprises a profiled vane 16 fixed at one end to a base 17. The latter has the general shape of a rectangular-sided figure of small height whose large sides 18 are slightly curved, the radius of curvature of the side 18 located adjacent the vane 16 corresponding to that of the wall 8 of the cavity 7 of the housing.

Figure 5:
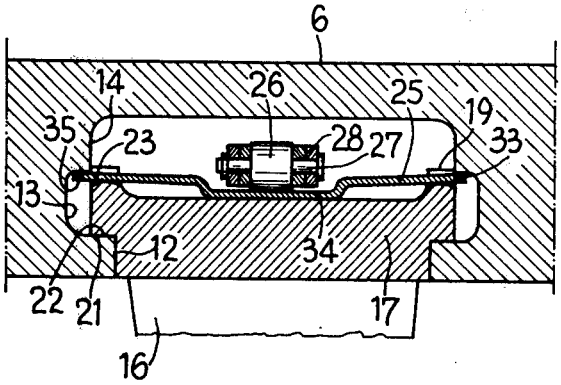
FIG. 5 is a sectional view taken on line 5—5 of FIG. 3.
Figure 6:
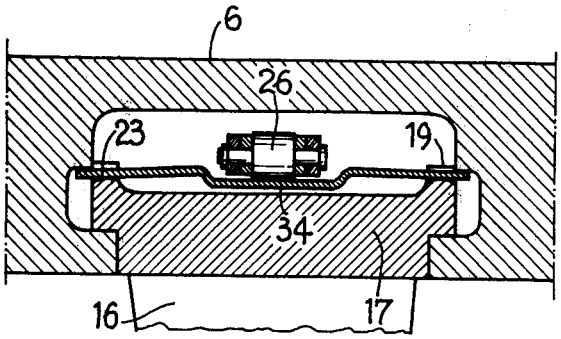
FIG. 6 is a view similar to FIG. 5 of the relative position of the various elements of the stator in the course of assembly.

The two small edges of the side 18 of this rectangular-sided figure opposed to the blade 16 are each provided with a heel 19 of rectangular cross-sectional shape extending throughout the length of this edge. The heels 19 extend in plan the large dimension of the rectangular-sided figure so as to impart to the base 17 a large overall size in plan which exactly corresponds to the axial dimension of the part 14 of the groove 11 and also to the axial dimension of the opening 15. The heels 19 thus define with the corresponding small sides 20 of the rectangular-sided figure, which are spaced apart a distance equal to the width of the inner part 12 of the groove 11, a radially outwardly facing shoulder 21 whose shape is complementary to the shoulder to the shoulder 22 defined by the inner parts 12 and 13 of the groove 11. The heels 19 are also in projecting relation to the side 18 of the rectangular-sided figure opposed to the vane 16 so as to impart to the base 17 a U-shape in a section on its major axis. Each of the heels 19 has, roughly in the middle of its side opposed to the vane 16, a shallow recess 23 of roughly rectangular cross section and having the same axis in plan as the base 17 and a longitudinally curved convex bottom (FIGS. 5 and 6).

When the stator S is in the assembled state, the bases 17 are disposed in the groove 11 one after the other to be contiguous. The shoulders 22 of the groove 11 and the shoulders 21 of the bases 17 cooperate in such manner as to hold each vane stationary in the axial direction. The radially outer end of the heels 19 is in contact with the wall of the outer part 14 of the groove 11 (FIGS. 5 and 6).

The vanes 9 are fixed in the groove 11 by means of a fixing device which comprises a chain 24 of adjustable tension and an elastically yieldable plate 25 for each vane 9.

The chain 24 comprises rigid links 28 which are interconnected by pivotal connecting means in the form of pins 27 on which rollers 26 are freely rotatable. The number of rollers 26 is equal to the number of vanes of a stage.

The length of the chain 24 between the two pins $27^a$ and $27^b$ of the end rollers $26^a$ and $26^b$ of this chain (FIG. 3) is slightly less than the length required for completely surrounding all the bases 17 disposed in the groove 11 in contacting relation to each other. The two ends of the chain 24 are interconnected by means of a tightening device 29 which comprises a stud 30 and two tapped cylinders $31^a$ and $31^b$ which are secured to each end of the chain 24. Lock-washers 32 of any type disposed on each screwthreaded part of the stud 30 enable the assembly to be locked in position to provide a predetermined distance between the two ends of the chain 24.

Figure 3:
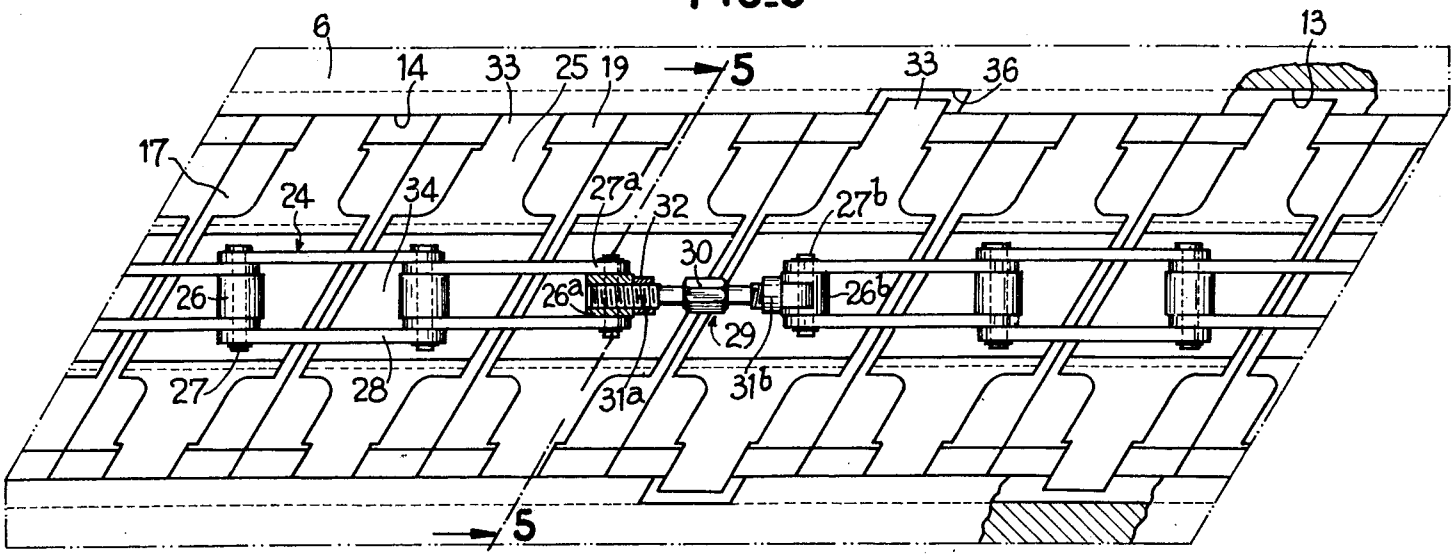
FIG. 3 is a sectional view of the same stator taken on the curved line 3—3 of FIG. 2 with parts cut away.

Eachh elastically yieldable plate 25 has an elongated shape and narrow end portions 33 adapted to be received in the recesses 23 of a base 17 and a median portion 34 which is slightly offset relative to the end portion 33 and whose width is slightly less than the width of the base 17 (FIG. 3). The end portions 33 of the plates 25 bear under the shoulders 35 defined by the parts 13 and 14 of the groove 11 and on the curved convex bottom of the recesses 23 in the bases 17 (FIG. 5). In the free state, the median parts 34 of the plates 25 are slightly spaced from the centre part of the bases 17 (FIG. 6). On the other hand, in the assembled state, a roller 26 of the chain 24 bears in the centre of this intermediate part 34 and, owing to the elasticity of the plate 25, the part 34 is made to bear against the outer face of the base 17 (FIG. 7). The intensity of this bearing force is of course a function of the tightening of the stretching device 29 or, in other words the distance between the ends of the chain 24. Thus it may be adjusted as required.

Figure 2:
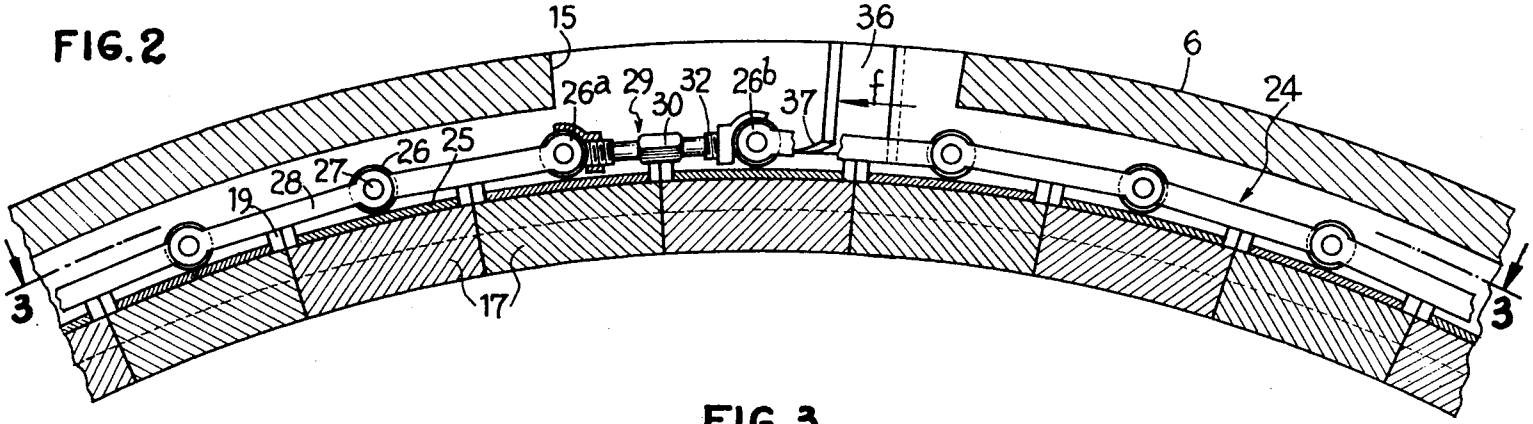
FIG. 2 is a partial sectional view to an enlarged scale of the stator of this compressor taken on line 2—2 of FIG. 1.

In order to allow the introduction of the plates 25 in their housing, each wall of the opening 15 transverse to the axis X—X is provided with a radial groove 36 allowing the passage of the end portions 33 of this plate. The radial grooves 36 are connected to the part 13 of the groove 11 by an inclined face 37 (FIG. 2).

The stator just described is assembled in the following manner:

The first vane 9 is introduced radially into the opening 15 and is disposed in such manner that the recesses 23 of the base 17 of this vane are in vertical alignment with the part of this opening 15 which is widened by the radial grooves 36. Then a plate 25 is inserted radially through this passage until the end portions 33 of this plate are disposed in the respective recesses 23. The assembly constituted by the vane 9 and the plate 25 is then slid in the direction of arrow *f* (FIG. 2) so that the end portions of the plate 25 cooperating with the inclined faces 37 are disposed under the shoulder 35 of the groove 11 by slightly arching the plate 25 under the effect of the elasticity thereof. The relative position of the plate and vane is then that shown in FIG. 6. This assembly is slid in the direction of arrow *f* to its final circumferential position then a second vane and a second plate 25 is introduced in a similar manner and this new assembly is slid into contact with the first assembly. In this way all the vanes 9 are introduced until the whole of the circumference of the groove 11 is occupied by bases 17 as can be in FIG. 2. One end of the chain 24 is then introduced through the opening 15 and made to travel through the whole of the circumference of the passage left free in the groove 11 between the radially outer face of the base 17 and the outer wall defined by the housing 6.

When this has been achieved, the two ends of the chain 24 appear in the opening 15 and it is merely necessary to place the stud 30 of stretching device 29 in position and progressively tighten it so as to cause the median part of the plates 25 to bear against the radially outer face of the bases 17, as shown in FIG. 5.

It will be understood that the stator S would be assembled in a similar manner with a plurality of openings 15 arranged on the circumference of one stage of vanes which would permit limiting the displacement of the vanes introduced through these openings to only a part of the circumference of the stator.

By way of a modification, each opening 15 may have inclined faces 37 which extend in the two circumferential directions. This still more reduces the distance that each vane must travel through to be placed in its final position.

Having now described my invention what I claim as new and desire to secure by Letters Patent is:

1. A compressor stator comprising in combination: a housing wall of revolution about an axis which wall is in one piece and defines an inner surface of revolution and an outer surface, means defining an annular groove in said wall extending radially outwardly from said inner surface and terminating short of said outer surface, the groove having a radially outer annular part and a radially inner annular part of smaller width axially of said wall than said outer part, said outer and inner annular parts of the groove defining therebetween radially outwardly fixing shoulder means, means defining in said wall at least one radial opening putting the groove in communication with said outer surface of said wall; at least one row of vanes, each of said vanes having a base which is mounted in the groove and has a width axially of said wall which is larger than the width of said inner part of the groove, the bases being in abutting relation to said shoulder means, the radial opening being of a size permitting the vane bases to be inserted one by one into the groove by way of the radial opening, the vane bases being in contiguous relation to each other, the groove defining with the vane bases an annular gap encompassing the row of vane bases; and annular fixing means disposed in said annular gap for clamping the vane bases radially against said shoulder means, the fixing means comprising a chain having chain links and pivotal connecting means interconnecting the links, and tightening means for tightening the chain round the vane bases, and the fixing means being capable of exerting a radial force on each one of the vane bases through the chain links.

2. A stator as claimed in claim 1, wherein the pivotal connecting means comprise spindles and rollers mounted on the spindles and capable of exerting said radial force on the bases.

3. A stator as claimed in claim 2, wherein the number of rollers of the chain is equal to the number of vanes of a row, each roller bearing against a base of a vane.

4. A stator as claimed in claim 1, wherein said radial force is exerted on the bases in the regions of said pivotal connecting means.

5. A stator as claimed in claim 1, wherein the chain occupies a sector of said annular clamping means and has two ends and the tightening means comprise a stud having screwthreaded end portions, tapped cylinders secured to the ends of the chain and respectively screwthreadedly engaged with the screwthreaded end portions of the stud, the stud being rotatable relative to the cylinders for adjusting purposes, and means for locking the stud and tapped cylinders against relative rotation after adjustment.

6. A compressor stator as claimed in claim 1, wherein the tightening means are located in said radial opening.

7. A compressor stator comprising a housing in one piece having a wall defining an inner cavity of revolution, and at least one stage of vanes, each of which vanes has a base for mounting in said wall, a circumferential groove in said wall, the groove having a radially inner part of reduced width and communicating with the exterior of the housing wall by way of at least one radial opening of sufficient size to provide a passage for a vane base, the vane bases being disposed in a contiguous manner in the groove and bearing radially inwardly against said inner part of the groove, and a chain surrounding all the bases and exerting a radial force against each one of the bases, each base having the shape of a parallelogram in plan and having a projecting portion extending along each of two opposed edges of the base, an elastically yieldable plate having two opposed end portions which bear against said projecting portions being interposed between each base and the chain.

8. A stator as claimed in claim 7, wherein each projecting portion is provided with a recess receiving one end portion of the corresponding plate, a median part of said plate being radially set back with respect to its end portions and being applied elastically against a median part of the base by the chain.

9. A stator as claimed in claim 8, wherein the recesses have curved and convex bottoms.

10. A stator as claimed in claim 7, wherein the groove and the opening have the same dimension axially of the housing and an axially extending circumferential recess is formed in each lateral wall of the groove, the end portions of the plate being engaged in said circumferential recess and radial recesses defining a passage of said end portions being provided in walls of the opening which are transverse to the axis of the housing.

11. A stator as claimed in claim 10, wherein an inclined surface interconnects each radial recess and the corresponding circumferential recess.

* * * * *